US006796010B2

(12) United States Patent
Noelle

(10) Patent No.: US 6,796,010 B2
(45) Date of Patent: Sep. 28, 2004

(54) METHOD FOR THE PRODUCTION OF NONWOVEN WEBS, THE COHESION OF WHICH IS OBTAINED BY MEANS OF FLUID JETS

(75) Inventor: Frédéric Noelle, Saint Nazaire les Eymes (FR)

(73) Assignee: Rieter Perfojet, Montbonnot (FR)

( * ) Notice: Subject to any disclaimer, the term of this patent is extended or adjusted under 35 U.S.C. 154(b) by 0 days.

(21) Appl. No.: 10/783,141

(22) Filed: Feb. 20, 2004

(65) Prior Publication Data

US 2004/0158962 A1 Aug. 19, 2004

Related U.S. Application Data

(62) Division of application No. 10/116,877, filed on Apr. 5, 2002, which is a continuation of application No. PCT/FR00/02633, filed on Sep. 22, 2000.

(30) Foreign Application Priority Data

Oct. 5, 1999 (FR) ..... 99 12601

(51) Int. Cl.[7] ..... D04H 1/46
(52) U.S. Cl. ..... 28/104; 28/167
(58) Field of Search ..... 28/104, 105, 106, 28/167, 163; 156/148; 68/200, 201, 205 R

(56) References Cited

U.S. PATENT DOCUMENTS

| | | | | | |
|---|---|---|---|---|---|
| 3,214,819 | A | | 11/1965 | Guerin | 28/72.2 |
| 3,485,706 | A | | 12/1969 | Evans | 161/72 |
| 3,494,821 | A | * | 2/1970 | Evans | 442/352 |
| 3,508,308 | A | | 4/1970 | Bunting, Jr. et al. | 28/72.2 |
| 4,083,090 | A | * | 4/1978 | Duvekot | 28/104 |
| 4,902,564 | A | * | 2/1990 | Israel et al. | 442/408 |
| 4,959,894 | A | * | 10/1990 | Jeffers et al. | 28/104 |
| 5,115,544 | A | | 5/1992 | Widen | 28/105 |
| 5,301,401 | A | * | 4/1994 | Suzuki et al. | 28/167 |
| 5,350,625 | A | * | 9/1994 | Peterson et al. | 428/219 |
| 5,369,858 | A | | 12/1994 | Gilmore et al. | 28/104 |
| 5,414,914 | A | * | 5/1995 | Suzuki et al. | 28/105 |
| 5,618,610 | A | * | 4/1997 | Tomita et al. | 428/152 |
| 5,632,072 | A | | 5/1997 | Simon et al. | 26/69 |
| 5,718,022 | A | * | 2/1998 | Vuillaume | 28/105 |
| 5,761,778 | A | * | 6/1998 | Fleissner | 28/104 |
| 5,768,756 | A | | 6/1998 | Noelle | 28/104 |
| 6,055,710 | A | * | 5/2000 | Fleissner | 28/104 |
| 6,270,623 | B1 | * | 8/2001 | Goda et al. | 162/114 |
| 6,324,738 | B1 | * | 12/2001 | Fleissner | 28/104 |
| 6,695,941 | B2 | * | 2/2004 | Hartgrove et al. | 156/148 |
| 2001/0005926 | A1 | | 7/2001 | Noelle | 28/104 |

FOREIGN PATENT DOCUMENTS

| | | | |
|---|---|---|---|
| EP | 0 423 619 A1 | 10/1990 | D04H/5/02 |
| EP | 0 446 432 A1 | 11/1990 | D04H/1/44 |
| EP | 0 511 025 A1 | 4/1992 | D04H/1/00 |
| FR | 2 734 285 | 5/1995 | D04H/1/44 |
| FR | 2 781 818 | 7/1998 | D04H/1/44 |
| GB | 1353756 | 4/1971 | D04H/1/70 |
| WO | WO 92/08832 | 11/1991 | D04H/1/46 |

* cited by examiner

*Primary Examiner*—Amy B. Vanatta
(74) *Attorney, Agent, or Firm*—Heslin Rothenberg Farley & Mesiti P.C.; John Pietrangelo

(57) ABSTRACT

A method for producing a nonwoven web formed at least partly with hydrophilic fibers is provided. In one aspect, the method comprises producing by carding a textile layer (10) which is then compressed and moistened; subjecting the textile layer to a bonding treatment using water jets acting at least against one of its surfaces; and transferring said bonded layer to a unit (32, 33) to be dewatered and dried. One aspect of the method is characterized in that, after the bonding treatment (20) with water jets and before drying and delivery, the pre-bonded and moistened layer is transferred to a supplementary unit (28) to be treated by the action of one or several series of water jets, the unit comprising a mobile suction surface in the form of a drum covered with an open-work structure (30) comprising a wire-mesh fabric, the wire-mesh fabric comprising successive raised and recessed zones.

1 Claim, 3 Drawing Sheets

Water
Water
Water 1
10
11
20
21
22
23
24
25
26
27
28
29
30
31
32
33
34

Water
Water
Water
Wood fibers

METHOD FOR THE PRODUCTION OF NONWOVEN WEBS, THE COHESION OF WHICH IS OBTAINED BY MEANS OF FLUID JETS

CROSS REFERENCE TO RELATED APPLICATIONS

This application is a Divisional of U.S. Ser. No. 10/116,877, filed Apr. 5, 2002, entitled METHOD FOR THE PRODUCTION OF NONWOVEN WEBS, THE COHESION OF WHICH IS OBTAINED BY MEANS OF FLUID JETS, which is a continuation of International Application No. PCT/FR00/02633, filed on Sep. 22, 2000, which designated the U.S. among others, and was published in French on Apr. 12, 2001 as WO 01/25522 A1, and claims priority from French patent application FR 99.12601, filed on Oct. 5, 1999, the entire disclosures of which are incorporated herein by reference.

TECHNICAL FIELD

For decades, it has been proposed to replace traditional webs (woven fabrics, knitted fabrics) by what are known as "nonwoven" structures which, in general terms, may be classified in three large categories by virtue of the actual process for manufacturing them, to be precise nonwovens known as "by the dry way" and "by the melted way" and nonwovens known as "by the wet way".

In the rest of the description, the present invention will be described as applied to obtaining nonwovens by the technique known as "by the dry way", but it is clear that it is not limiting and that, if appropriate, it could be applied to the other two categories of nonwovens.

One of the main problems which arises during the production of nonwovens is that of achieving the cohesion of the structure in order to give the products mechanical characteristics according to the application in question, while maintaining or imparting particular physical characteristics, such as bulk, handle, appearance, etc.

Among the techniques proposed hitherto, such cohesion is obtained by the intermingling of the fibers in the thickness of the web by means of the action of fluid jets and, more particularly, of jets of water under pressure.

Such a technique of treatment by means of water jets has been proposed for decades, as may be gathered from the U.S. Pat. Nos. 3,214,819, 3,508,308 and 3,485,706.

In general terms, this technique involves carrying out the interlacing of the elementary fibers with one another by means of the action of jets of water under pressure which act on the fibrous structure in the manner of needles and make it possible to reorient part of the fibers forming the web in the direction of thickness.

Such a technology has been widely developed at the present time and is used not only for producing what are known as "spunlace" structures for textile use, such as, in particular for applications in the medical and hospital fields, for wiping, filtration and wrappings for teabags, but also for making tiny perforations in continuous supports such as paper, cardboard, films, even sheets of plastic or the like and the articles obtained may be regular and homogeneous and take the form of a plane sheet which, if appropriate, may have perforations, as may be gathered from the patent U.S. Pat. No. 3,508,308, and even, if appropriate, comprise designs resulting from the reorientation of the fibers, this being essentially for an esthetic purpose, as may be gathered from U.S. Pat. No. 3,485,706.

As regards the applications of such products of the "spunlace" type, it has been known for a very long time that the final properties of the product obtained can be adapted by producing mixtures of material, for example by combining with one another a plurality of webs consisting of fibers of different types, for example of natural, artificial or synthetic fibers, even from webs in which the fibers are previously mixed, reinforcements (woven or nonwoven nettings, webs of the "spunbond" type, etc.) being capable, if appropriate, of being incorporated into the nonwoven structure.

Of the numerous applications of nonwovens, mention may be made of wiping products known as "wet wipes", and of products in the hygiene field.

In addition to good mechanical characteristics both in length and in width, also both in the dry state and in the wet state, such products must also have the essential characteristic of having a good capacity for the absorption and retention of the liquid or treatment product which they support or which they must absorb. Moreover, they must have good dimensional stability and be flexible, soft, bulky and pleasant to handle.

The invention is particularly suitable for producing such articles, and, in the rest of the description, it will be described more particularly for obtaining such products.

PRIOR ART

Hitherto, to produce wiping cloths or wet wipes, it has been conceivable to use nonwoven webs consisting entirely of absorbent fibers, such as cellulose fibers, particularly viscose fibers. In order to give the product good mechanical characteristics, a mixture of synthetic fibers (polyester, polypropylene) and of artificial fibers (viscose) is preferably used.

To produce such articles consisting of a mixture of fibers, either an intimate mixture of said fibers can be produced, which is converted into a homogeneous unitary web, or the combination of two webs previously produced is carried out, to be precise, one web based on discontinuous fibers or on continuous synthetic filaments (polyester, polypropylene) and the second based on artificial fibers (viscose), and said webs are combined by hydraulic entanglement.

It has also been proposed, in order to produce such articles, to replace the artificial fibers which give the web the capacity for the absorption and retention of the liquid with natural cellulose fibers, such as wood fibers, incorporated in the same proportions as the prior products based on artificial or synthetic fibers, said natural cellulose fibers being entangled with the chemical fibers likewise by treatment by means of water jets.

Such a product has good mechanical resistance characteristics, essentially afforded by the synthetic fibers, and good liquid absorption and retention characteristics imparted by the cellulose fibers.

French patents FR-A-2 730 246 and 2 734 285, these patents corresponding respectively to the patents U.S. Pat. No. 5,718,022 and U.S. Pat. No. 5,768,756, describe solutions which make it possible to successfully treat hydrophobic fibers or mixtures of these fibers with other hydrophilic fibers or even webs consisting entirely of natural fibers by means of water jets.

In general terms, according to the teachings of these documents, the treatment involves treating a basic web composed of elementary fibers of the same type or of different types, compressing and moistening this basic web and then intermingling the fibers by means of at least one rack of contiguous jets of water under high pressure acting on the basic web.

For this purpose, the basic web is advanced positively on an endless porous support in motion, and it is brought onto the surface of a perforated rotary cylindrical drum, to the interior of which a partial vacuum is applied.

The basic web is compressed mechanically between the porous support and the rotary drum which both advance substantially at the same speed.

Immediately downstream of the compression zone, a water curtain is directed onto the web and passes successively through the porous support, the compressed basic web and the supporting perforated drum which sucks up the excess water.

The elementary fibers are intermingled continuously, still on the rotary cylindrical drum, by the compressed and wetted web being subjected to the action of at least one rack of jets of water under high pressure. In general, bonding is carried out by means of a plurality of successive racks of water jets which act either on the same face or alternately against the two faces of the web, the pressure within the racks and the velocity of the jets discharged varying from one rack to the next and usually progressively.

Moreover, it is appropriate to note, as may be gathered from FR 2 734 285, that the perforated roller preferably comprises randomly distributed micro-perforations.

If appropriate, after this bonding treatment, the nonwoven structure may be subjected to a second treatment applied to the reverse face.

PRESENTATION OF THE INVENTION

A method has been found, this being the subject of the present invention, which not only makes it possible to produce absorbent nonwovens having excellent physical properties (tensile strength, tearing strength, abrasion resistance) and a good capacity for the absorption and retention of liquid similar to articles of the same composition obtained according to the teachings of FR-2 734 285 but which, moreover, has, in relation to such articles, a more pleasant handle and increased bulk.

In general terms, therefore, the invention relates to a method making it possible to produce a novel type of nonwoven consisting at least partially of hydrophilic elementary fibers, which involves continuously:

- producing a fibrous web by carding or another conventional technique;
- compressing and moistening said web;
- subjecting the moistened and compressed web to a bonding treatment by means of water jets acting at least against one of its faces, the web being supported by a rotary drum comprising randomly distributed micro-perforations, a partial vacuum being applied to the interior of said drum;
- transferring said bonded web to an assembly making it possible to drain and dry it before it is received, in particular in the form of a wound package.

The method according to the invention is characterized in that, after bonding treatment by means of water jets and before drying and reception, the prebonded and moistened web is transferred to an additional assembly for treatment by the action of one or more series of water jets, said assembly comprising a movable suction surface taking the form of a drum covered with an open-work structure consisting of a woven metal-wire cloth and shaped to have a succession of raised and recessed zones.

For implementing the method according to the invention, the first treatment by means of water jets is carried out according to the teachings of FR-A-2 730 246 and FR-A-2 734 285, the content of which is incorporated in the present description as required.

The additional treatment by means of jets which is carried out before the drying of the web is obtained, as mentioned above, by causing it to pass onto the surface of a perforated rotary cylindrical suction drum. In a known way, such a drum consists of a honeycomb structure which is covered with a perforated plate and which rotates about a second hollow fixed coaxial cylindrical drum connected to a partial vacuum source in order to form a suction box below the zones where the water jets act. According to the invention, said drum is covered with a likewise perforated or intrinsically porous structure having raised and recessed zones, this structure preferably consisting of a woven fabric taking the form of a removable sleeve.

By virtue of such a design, it is therefore easy, simply by changing this sleeve, to modify the appearance and characteristics of the product obtained.

As covering structure, preferably used for the suction drum will be a woven cloth which is produced, for example, from bronze wires, and which has the characteristic of being capable of being embossed.

In such a structure, the ratio of emptiness in relation to the surface is between 10% and 50%, and the overall height between the bottom of the recessed parts and the upper part of the raised zones is generally between 0.5 mm and 2 mm.

The configuration of the raised and recessed portions which such a cloth will have may be of any type, for example, may take the form of herringbones, of designs with exact contours (circular, square) or a crimped, crinkled, etc. appearance.

In a variant according to the invention, before treatment on the embossed surface, the complex may, if appropriate, receive a second bonding treatment by means of jets, which is carried out in a similar way to the preceding treatment, but on the opposite face.

After treatment, the nonwoven, still in the wet state, is transferred to a squeezing-out zone, followed by a drying zone consisting of a through-air drum. Finally, it is received in the form of a wound package.

Such a method can be implemented for fibrous webs of any composition produced from natural, artificial and/or synthetic fibers taken alone or in a mixture.

For the production of absorbent nonwovens, it is conceivable to produce a web consisting entirely of viscose fibers.

Preferably, however, a mixture of absorbent artificial fibers (viscose) and of synthetic fibers, such as polyester or polypropylene, will be used.

In such mixtures, the linear density of the elementary fibers and their length are preferably similar and, for example, are between 1 dtex and 3.3 dtex, the length being between 20 mm and 60 mm.

It is also conceivable to adapt the method so as to incorporate natural fibers, such as wood fibers, into the web, for example by pneumatic lapping followed by hydraulic bonding by means of racks of jets acting against the face on which the wood fibers were distributed.

This operation of pneumatic lapping and bonding is carried out before shaping treatment on the embossed assembly, the jets of this assembly preferably acting against the surface covered with wood fibers.

BRIEF DESCRIPTION OF THE DRAWINGS

The invention and the advantages which arise from it will be understood more clearly, however, from the following exemplary embodiments given as a nonlimiting indication and illustrated by the accompanying diagrams in which.

IMPLEMENTATION OF THE INVENTION

Figures 1, 1A, 1B, 1C:
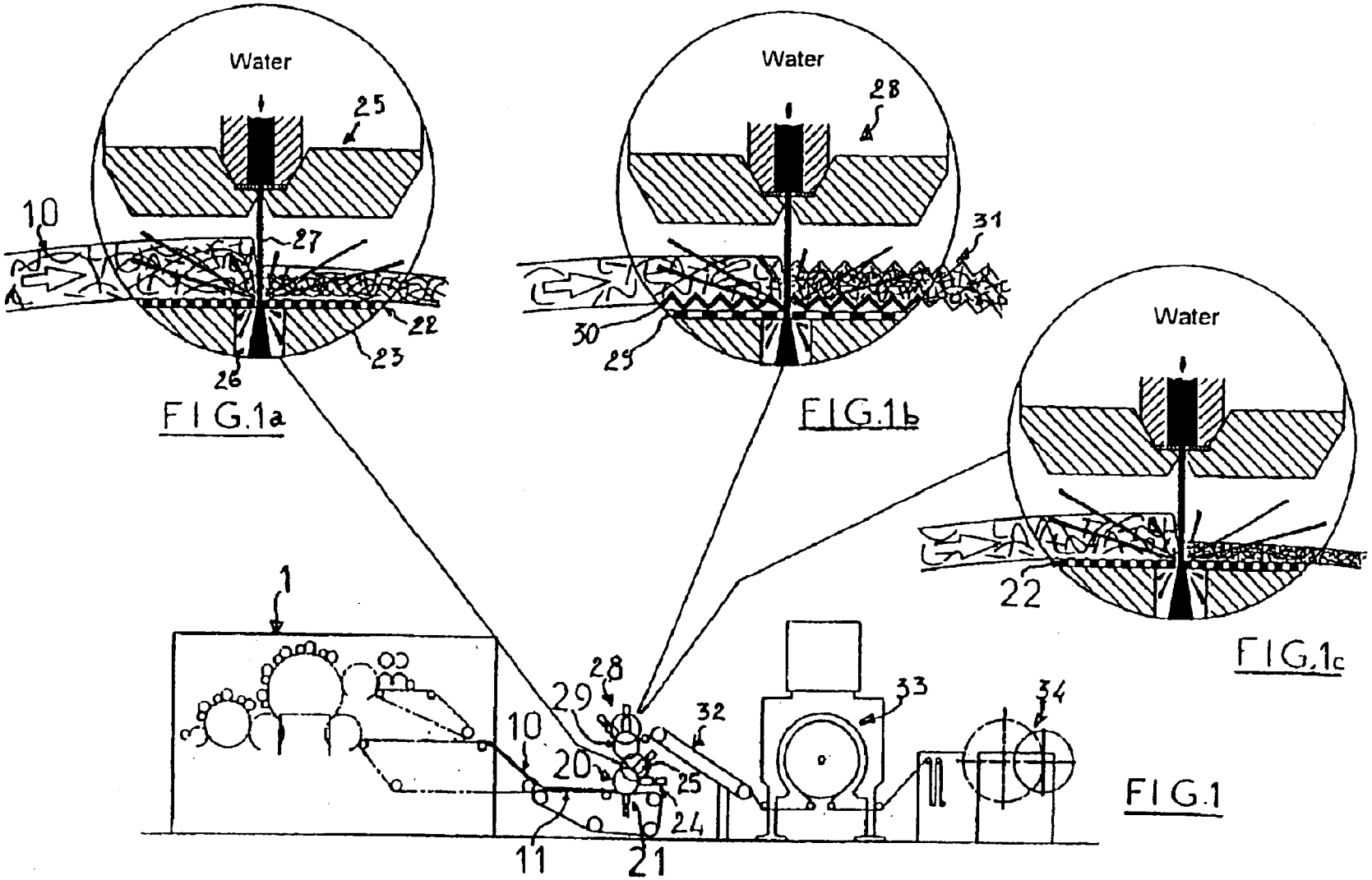
FIG. 1 is a diagrammatic view of the whole of a production line for a nonwoven web according to the invention, the cohesion of which is imparted by the action of jets of water under pressure, FIGS. 1*a* and 1*b* being enlarged views of the zones circled in this FIG. 1, and FIG. 1*c* illustrating the structure of a conventional bonding zone used within the framework of the comparative examples which will be given later.

Referring to the accompanying FIGS., and more particularly to FIGS. 1, 1*a* and 1*b*, a production line making it possible to produce a nonwoven in accordance with the method according to the invention is composed essentially of an assembly, designated by the general reference (1), making it possible to produce, by carding or another similar technique, a web which may consist either entirely of artificial fibers, particularly viscose, or of a mixture of artificial fibers and of synthetic fibers, such as polyester or polypropylene.

At the exit of the zone for shaping the web (10), the latter is transferred onto a porous conveyer belt (11) consisting, for example, of an endless cloth which is produced from synthetic monofilament, in particular from polyester, and which has a porosity of between 30 and 60%, that is to say a ratio between the solid areas and the empty areas of between 30 and 60%, preferably around 50%.

This porous support (11) is associated, in a way similar to the teachings of FR-A-2 730 246, with an assembly for treatment by water jets, making it possible, on the one hand, to ensure the compression and wetting of the web (10) formed and, on the other hand, to subject this web to the action of racks of water jets. Such an assembly comprises essentially a rotary cylindrical drum designated by the general reference (20), in bearing contact against the surface of the conveyer belt (11).

A first rack of water jets (21) is arranged below the support (11) and makes it possible to carry out the prewetting of the web (10). This rack is arranged at a distance of between 70 and 100 mm from the porous support (11) and forms a water curtain making it possible to wet the compressed web and bringing about a first slight intermingling of the web.

The drum (20) is composed of a conventional rotary cylinder with a honeycomb structure (not illustrated in the accompanying FIGS.), which is covered with a metal film (22) comprising microperforations distributed randomly on its surface or with a woven structure. This rotary cylinder surrounds a second hollow fixed coaxial cylindrical drum (23) connected to a partial-vacuum source so as to form a suction box, suction being applied through slits (26) located opposite the active zone of the water jets.

After prewetting by means of the rack (21), and as may be gathered from FIGS. 1 and 1*a*, the web (10) is subjected to the action of jets of water under pressure (27) coming from two conventional racks (24, 25).

If appropriate, it would be conceivable to have only a single rack (24) or more than two successive racks associated with the drum (20).

These racks (21, 24, 25) are formed from contiguous injectors arranged at predetermined distances from one another.

Opposite each rack. (21, 24, 25) the drum comprises a slit (26) which extends over the entire length of a generatrix, the width of which is generally between 5 mm and 30 mm and through which the water of the jets (27) is recovered.

After bonding on the assembly (20), the web is subject to the action of a second assembly (28) which is produced according to the invention, and the general structure of which may be gathered from FIG. 1*b*. This assembly (28) consists of a rotary suction drum (29), which likewise consists of a honeycomb cylindrical structure, not illustrated in FIG. 1*b*, and which does not support a microperforated band, as in the case of the treatment assembly (20), but, instead, a covering consisting of an open-work plate (29). As an indication, the perforations of this plate (29) may have a diameter of 3 mm, the center distance between two consecutive orifices being 4 mm, and the orifices being offset from one row to the next.

According to the invention, the perforated surface (29) is covered with a sleeve-shaped open-work structure (30) having a succession of raised and recessed zones.

Figure 3:
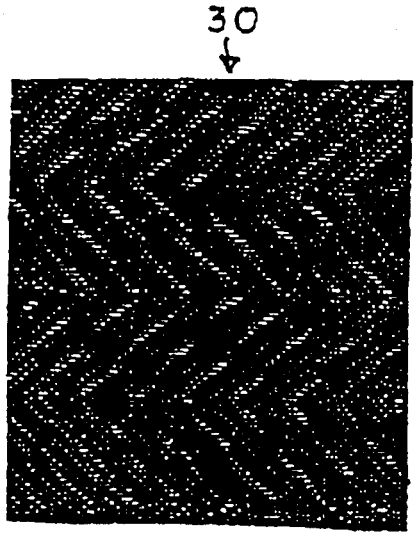
FIG. 3 is a reproduction of an embossed structure used within the scope of the invention.
Figure 5:
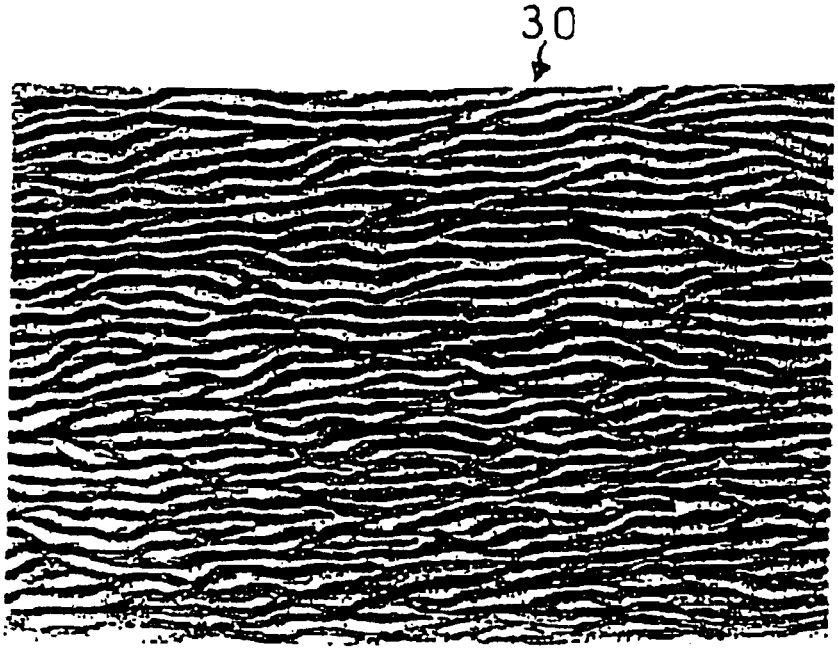
FIG. 5 is another embodiment in which the embossed surface makes it possible to obtain a recessed and raised effect of the "crinkled" type.

This open-work structure (30) consists of an open-work cloth made from metal wires, more particular from bronze wires, having an aperture ratio of between 10% and 50%, said cloth having been embossed, as may be gathered from FIGS. 3 and 5, in order to comprise a succession of raised and recessed zones. These raised and recessed zones may have a regular structure, for example a herringbone shape, as illustrated in FIG. 3, or a configuration forming irregular designs, giving, for example, a crinkled appearance, as illustrated in FIG. 5.

As may be gathered from FIG. 1*b*, during its passage through this additional treatment zone (28), the prebonded web is restructured by the action of one or more series of jets coming from conventional hydraulic injectors, of which there are two in the present instance. Under the action of these jets, the web matches the configuration of the raised and recessed zones of the open-work,structure (30). After treatment, the treated web (31) is delivered onto a conveyer (32), where the water is eliminated, for example with the aid of a suction box arranged below the conveyer (32), the treated web then being;dried by passage over a through-air cylinder (33) having a temperature of the order of 150° C., before being received in the form of a wound package (34).

Figures 2, 2A, 2B, 2C, 2D:
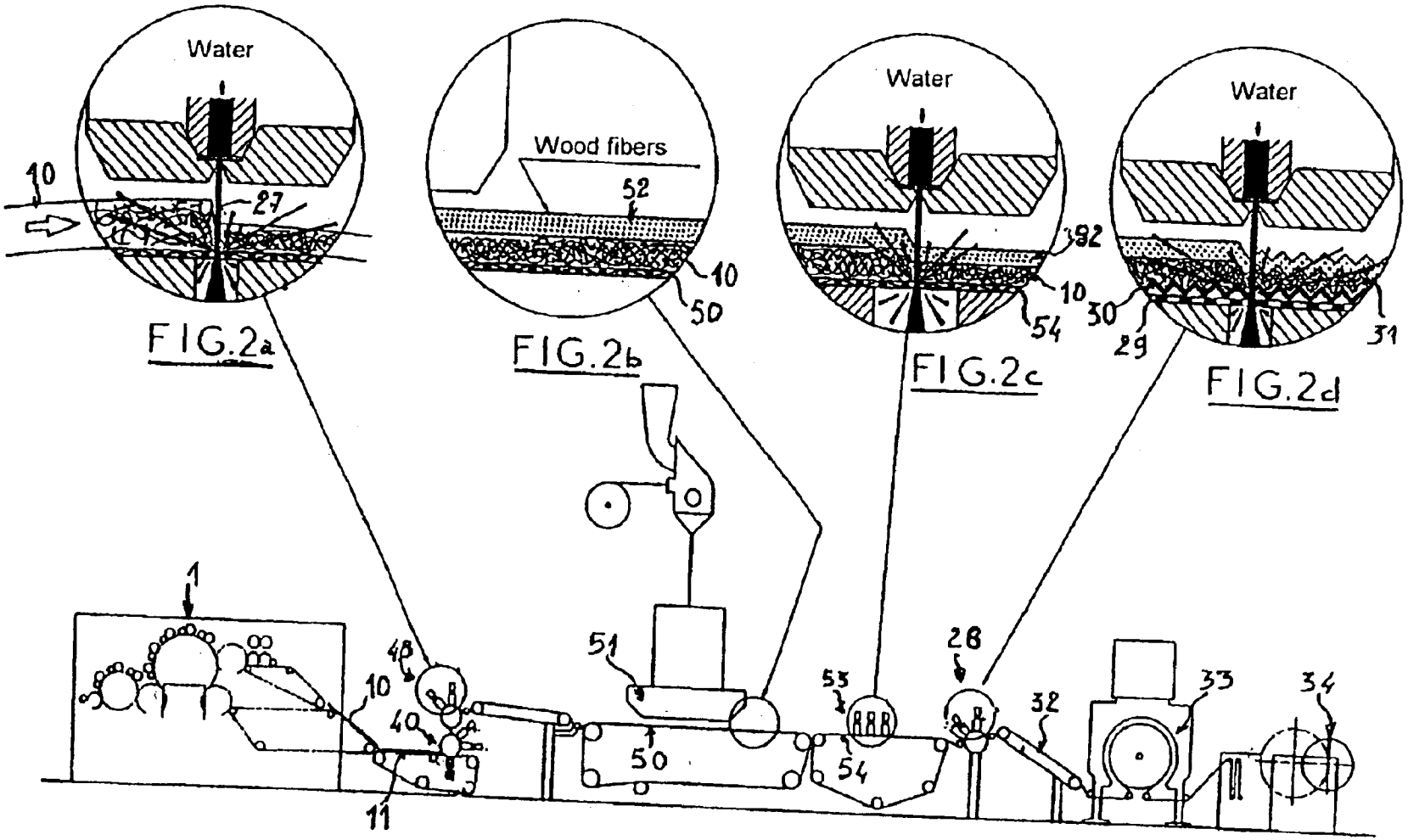
FIG. 2 is a diagrammatic view of a production line for a nonwoven web produced according to the invention, making it possible to produce mixed webs, synthetic fibers/wood fibers, FIGS. 2*a*, 2*b*, 2*c* and 2*d* being enlarged views of the zones circled in FIG. 2.

FIG. 2 illustrates a second embodiment of a production line for a nonwoven, making it possible to produce mixed webs, synthetic fibers—cellulose fibers, for example wood fibers, which is designed for implementing the method according to the invention.

FIGS. 2*a*, 2*b*, 2*c* and 2*d* are enlarged views of the treatment zones circled in FIG. 2.

In general terms, such a production line is produced according to the teachings of the document FR-A-2 781 818, which makes it possible to produce nonwovens consisting of a mixture of elementary fibers of different types and, more particularly, of a mixture of synthetic fibers which is associated with cellulose fibers, in particular wood fibers.

In general terms, in such an installation, a mixed nonwoven is produced in the following way. First of all, a first web (10) is produced, by carding (1) or another conventional technique, from chemical fibers. The fibrous web (10) produced is then subjected to a bonding treatment by means of water jets on a first treatment assembly designated by the reference (40).

In this treatment phase, the two faces of the fibrous web (10) are subjected to the action of water jets by passage around two suction cylinders, the first comprising microperforations on the surface and the second being covered with a coarse cloth, as may be gathered from FIG. 2*a*.

After the web has been treated, it is transferred onto a conveyer (50), and natural fibers (52), such as wood fibers (cf. FIG. 2), are deposited on the surface of said web (10).

The complex structure, web of synthetic fibers (10) which is covered with natural fibers (52), is then subjected to the action of a new series of water jets by means of an assembly, designated by the general reference (53), positioned above a second conveyer. This treatment ensures not only the bonding, but also the prewetting of the web, necessary for implementing the method according to the invention.

The complex structure thus produced is subsequently treated, according to the invention, on an assembly, designated by the general reference (28), illustrated in FIG. 2*d*, this assembly being similar to that illustrated in FIG. 1*b* and described above.

After treatment, a mixed nonwoven (31) is obtained, comprising raised and recessed designs, which is received on a belt (32) in order subsequently to be dried at (33) and received at (34).

EXAMPLE 1

The method according to the invention is implemented on an installation, as illustrated by FIGS. 1, 1*a* and 1*b*, for the purpose of producing a product according to the invention consisting of a single type of hydrophilic fibers, to be precise viscose fibers.

To this effect, a web (10) is produced, weighing approximately 65 $gm^2$ and composed of 100% viscose fibers of 1.7 dtex and with a length of 38 mm, this web being produced at a speed of 50 m/min by a card for nonwovens (1).

This web (10) is transported by a conveyer belt (11) to a hydraulic bonding unit of the type sold under the designation "Jetlace 2000", designed for implementing the method according to the invention.

The web (10) is compacted between the transport conveyer (11) and a first bonding cylinder (20), covered with a microperforated casing, the holes being arranged randomly, as described in French patent 2 734 285. During compaction, the web is wetted by means of the rack (21) located behind the transport conveyer, just after the compacting point, said rack being arranged perpendicularly to the generatrix of the cylinder.

The web thus compacted and wetted is then subjected to the action of two successive hydraulic injectors (24, 25) projecting water jets (27) with a diameter of 120 microns at increasing velocities of 100 and 125 m/second, the water jets being spaced 1.2 mm from one another.

After bonding treatment, the bonded web undergoes additional treatment according to the invention (FIG. 1*b*) by being passed over a cylinder, likewise covered with a perforated casing (29) on which is arranged a sleeve consisting of a bronze fabric (30) comprising 15 wires/cm and 15 wefts/cm, having a diameter of 0.24 mm and possessing an emptiness ratio of 40.8%.

This bronze sleeve (30) is embossed so as to have a herringbone design (as illustrated in FIG. 5), the depth of which is of the order of one and a half millimeters (1.5 mm).

The fibrous web is subjected to the action of two successive hydraulic injectors delivering jets with a diameter of 120 microns at a velocity of 200 m/second, the jets being spaced 0.6 mm from one another.

The web is subsequently transferred onto a suction belt (32) connected to a vacuum generator, then dried at a temperature of 145° C. in a through-air oven (33), in order finally to be received, for example, in the form of a wound package (34).

Figure 4:
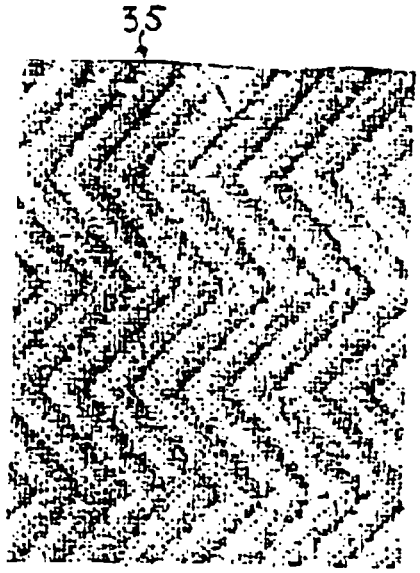
FIG. 4 is a reproduction of the effect obtained on the final product.

A nonwoven is obtained, which weighs approximately 60 $g/m^2$ and has a herringbone design (35), as illustrated in FIG. 4, this design having excellent definition. It is permanent and friction-resistant.

EXAMPLE 2

The treatment conditions are the same as those given in example 1.

A product consisting of a 70/30 mixture of viscose and polyester fibers is produced.

The fibers have a linear density of 1.7 dtex and a length of 38 mm.

The web formed weighs approximately 65 $g/m^2$ at the exit of the card and 60 $g/m^2$ after treatment.

EXAMPLE 3

This example illustrates an actual embodiment of a nonwoven according to the invention, consisting of a mixture of synthetic fibers and of natural fibers, and, more particularly, of cellulose fibers, especially wood fibers.

According to this exemplary embodiment, a production line, as illustrated in FIG. 2, is used, which, in general terms, is produced according to the teachings of the document FR-A-2 781 818, except that it comprises, before drying at (33), and after bonding and prewetting treatment carried out by means of the jets (53), an additional assembly (28) for treatment by the action of water jets, said assembly comprising a movable suction surface taking the form of a drum covered with an open-work structure (30) and consisting of a woven metal-wire cloth shaped so as to have a succession of raised and recessed zones.

In this exemplary embodiment, a first web (10) is produced at 60 m/min, weighing 30 $g/m^2$ and consisting of polyester fibers of 38 mm and of 1.7 dtex, said web being introduced to a hydraulic bonding unit of the type sold by the applicant under the designation "Jetlace 2000", by means of a transport conveyer (11).

The web is compacted between this conveyer and a first assembly, designated with the general reference (40), which comprises a bonding cylinder covered with a microperforated casing, the holes of which are arranged randomly. After compaction, the web is prewetted by means of a rack located behind the transport conveyer (11), just after the compacting point, and arranged perpendicularly to the generatrix of the cylinder.

The web thus compacted and wetted is subjected to the action of two hydraulic injectors projecting water jets with a diameter of 120 microns at increasing velocities of 78 and 94 m/s, the water jets being spaced 1.2 mm from one another.

The web is then introduced to the assembly designated by the general reference (48), which comprises a second cylinder covered with a coarse cloth consisting of 9 wires per centimeter, made of bronze, with a rectangular cross section with sides of 0.3 mm by 6.64 mm in the warp direction and of 9 wires per centimeter, likewise made of bronze, with a diameter of 0.46 mm in the weft direction.

Two hydraulic injectors are arranged above this cylinder. They project onto the web water jets with a diameter of 120 microns at velocities of 100 m/s, the jets being spaced 0.5 mm from one another.

The web is then squeezed out with the aid of a suction box connected to a vacuum generator.

The product at the exit of this conveyer has a crimped appearance of the pyramidal type, with different fiber density zones.

The web is then introduced to a pneumatic lapping machine (51) which deposits 35 g/m$^2$ of cellulose fibers.

After these fibers have been deposited, the web is introduced onto another conveyer (54), above which are arranged four hydraulic injectors (53) projecting water jets with a diameter of 120 microns, spaced 0.6 mm from one another, at velocities of 150 m/s.

The product thus obtained therefore takes the form of a prebonded and moistened web which is subsequently transferred to an additional treatment assembly, designated by the general reference (28). Such an assembly comprises a cylinder covered with a bronze sleeve which is identical to that used in example (1) and which is embossed so as to have a herringbone design.

The fibrous web is subjected to the action of two successive hydraulic injectors delivering jets with a diameter of 120 microns at a velocity of 60 m/s, the jets being spaced 0.6 mm from one another.

The product thus obtained by the method according to the invention is subsequently transferred onto a suction belt (32) connected to a vacuum generator and is then dried at a temperature of 160° C. in a through-air oven, in order, finally to be received in the form of a wound package (34).

After drying, a complex having raised and recessed designs, which is illustrated in FIG. 4 is obtained.

COMPARATIVE EXAMPLES

The same examples as above are produced, with the exception of the following differences. As regards examples 1 and 2, these are produced on an installation in which the treatment assembly (28), as illustrated in FIG. 1*b*, is produced by means of a second series of jet treatments, as illustrated in FIG. 1*c*, that is to say on a conventional suction drum, the surface covering of which consists of a microperforated film (22) similar to that used for the prebonding treatment.

Where example 3 is concerned, this is produced on a production line, as illustrated in FIG. 2, but not comprising a treatment assembly (28).

Proceeding in the same way, nonwovens are obtained which have the same composition and virtually the same weight as those produced according to the invention, but do not comprise any designs.

The products obtained according to the invention and those of the comparative examples are tested in order to determine the thickness, the density, resistance in the longitudinal direction (SL) and in the transverse direction (ST), elongation in the longitudinal direction and in the transverse direction and the water absorption rate.

The results are collated in the following table.

TABLE

| Characteristics | | Example 1 | Comparative | Example 2 | Comparative | Example 3 | Comparative |
|---|---|---|---|---|---|---|---|
| Weight g/m$^2$ | | 60 | 60 | 60 | 60 | 55 | 55 |
| Thickness in mm | | 0.71 | 0.50 | 0.82 | 0.58 | 0.61 | 0.44 |
| Density in g/cm$^3$ | | 0.085 | 0.12 | 0.073 | 0.103 | 0.090 | 0.125 |
| Resistance in the longitudinal direction (SL) N/50 mm | dry | 115 | 120 | 112 | 114 | 108 | 110 |
| | wet | 58 | 59 | 98 | 92 | 99 | 101 |
| Resistance in the transverse direction (ST) N/50 mm | dry | 21 | 20 | 18 | 22 | 21 | 19 |
| | wet | 15 | 14 | 17 | 20 | 18 | 17 |
| Elongation in the longitudinal direction (SL) in % | dry | 25 | 29 | 30 | 27 | 31 | 30 |
| | wet | 26 | 28 | 35 | 33 | 30 | 29 |
| Elongation in the transverse direction (ST) in % | dry | 123 | 134 | 129 | 133 | 185 | 189 |
| | wet | 99 | 100 | 124 | 126 | 184 | 185 |
| Absorption rate g/g | | 928 | 906 | 850 | 826 | 833 | 824 |

As compared with products produced conventionally, and as may be gathered from the above table, the materials produced according to the invention, have the advantage of being much thicker for an equal weight.

Moreover, their resistance both in the longitudinal direction and in the transverse direction are comparable to those of products produced conventionally, thus ensuring that they have stability and resistance during use.

In addition to their increased thickness, the novel products have an agreeable and favorable textile appearance which increases their commercial value.

Of course, the invention is not limited to the actual exemplary embodiments given above, but embraces all their variants produced in the same spirit.

Moreover, although, in the examples given, an embossed bronze fabric comprising 15 wires in warp and in weft, of which the diameter is 0.24 mm and the aperture ratio 40.8%, is used, it will be conceivable to use other types of embossed structures.

As an example, when products similar to those given in the quoted examples are produced, which do not have a "herringbone" appearance as illustrated in FIGS. 3 and 4, but, instead a "crinkled" appearance, as illustrated in FIG. 5, it was found that higher definition and an increase in the relief of the designs were obtained, using an embossed fabric produced from bronze wires with a smaller diameter and having a greater wire density.

As an indication, in order to produce such fabrics, the embossed bronze cloth has 23.5 wires/cm both in warp and in weft, said wires having a diameter of 0.19 mm and the aperture ratio being 30.5%.

Furthermore, as indicated above in the description and as illustrated in FIG. 2, the method according to the invention may also be implemented in order to obtain mixed nonwovens consisting of a mixture of fibers of different types.

What is claimed is:

1. A method for producing a nonwoven web comprising at least partially of hydrophilic fibers, the method comprising continuously:

providing a fibrous web;

compressing and moistening said web;

subjecting the moistened and compressed web to a bonding treatment by means of water jets acting at least against one of the faces of the web, the web being supported by a rotary drum comprising an exterior having distributed microperforations and an interior having at least some vacuum; and draining and drying the web, characterized in that, after the bonding treatment by means of water jets and before draining and drying the web is transferred to an additional assembly for treatment by one or more series of water jets, wherein said additional assembly comprises a movable suction surface comprising a drum covered with a sleeve defining an open-work structure, the open-work structure comprising a woven bronze-wire cloth having a succession of raised zones having an upper part and recessed zones having a bottom, wherein the suction surface comprises a ratio of emptiness of between 10 and 50%, and wherein the overall height between the bottom of the recessed zones and the upper part of the raised zones is between 0.5 and 2 mm.

* * * * *